US005092100A

United States Patent [19]

Lambert et al.

[11] Patent Number: 5,092,100

[45] Date of Patent: Mar. 3, 1992

[54] WALL OR LINING STRUCTURE

[75] Inventors: James H. Lambert, Loughborough; Gersham W. O. Smith, Gotham, both of England

[73] Assignee: BPB Industries Public Limited Company, Slough, England

[21] Appl. No.: 300,234

[22] Filed: Jan. 23, 1989

Related U.S. Application Data

[63] Continuation of Ser. No. 53,015, May 22, 1987, abandoned.

[30] Foreign Application Priority Data

May 22, 1986 [GB] United Kingdom ..... 8612473

[51] Int. Cl.[5] ..... E04B 2/30

[52] U.S. Cl. ..... 52/774; 52/481; 52/508

[58] Field of Search ..... 52/424, 434, 508, 481, 52/490, 731, 732, 764, 766, 772, 773, 774; 24/545, 546, 563

[56] References Cited

U.S. PATENT DOCUMENTS

| | | | |
|---|---|---|---|
| 1,826,133 | 10/1931 | Hatch | 52/772 |
| 1,946,694 | 2/1934 | Hunter | 52/731 |
| 2,178,507 | 10/1939 | Williams | 52/773 |
| 2,742,776 | 4/1956 | Peirce | 52/772 |
| 3,457,698 | 7/1969 | Albers | 52/772 |
| 3,921,346 | 11/1975 | Sauer et al. | 52/481 |
| 3,950,900 | 4/1976 | Simpson | 52/773 |
| 4,231,205 | 11/1980 | Wendt | 52/481 |
| 4,250,927 | 2/1981 | Newburg | 24/546 |
| 4,283,891 | 8/1981 | Moeller | 52/774 |
| 4,324,082 | 4/1982 | Rutkowski et al. | 52/481 |
| 4,364,212 | 12/1982 | Pearson et al. | 52/481 |
| 4,435,936 | 3/1984 | Rutkowski | 52/481 |

FOREIGN PATENT DOCUMENTS

| | | | |
|---|---|---|---|
| 549709 | 12/1957 | Canada | 52/773 |
| 979931 | 12/1950 | France | 52/481 |
| 1386642 | 12/1964 | France | 52/773 |
| 314576 | 8/1956 | Switzerland | 52/773 |
| 622156 | 4/1949 | United Kingdom | 52/773 |
| 979847 | 1/1965 | United Kingdom | 52/773 |

*Primary Examiner*—Michael Safavi
*Attorney, Agent, or Firm*—Birch, Stewart, Kolasch & Birch

[57] ABSTRACT

A wall or lining structure for shafts, ducts or barriers comprises panel members (11) supported by studs (10) having spaced parallel flanges (13,15). The panels are held against the inner surface of at least one flange by an independent spacer member (14) having different cross-sectional dimensions in different directions. Different numbers of thicknesses of the panel members can be accommodated between the flanges of identical studs by varying the orientation of identical spacer members relative to the studs.

11 Claims, 5 Drawing Sheets

WALL OR LINING STRUCTURE

This application is a continuation of application Ser. No. 053,015 filed on May 22, 1987, now abandoned.

BACKGROUND OF THE INVENTION

The present invention relates to wall or lining structures comprising panel members supported by generally vertical studs. It is more especially concerned with structures suitable as shaft, duct or other wall linings or barrier walls which are required to have substantial fire resistance.

Wall structures of this kind commonly comprise several thicknesses of panel members, for example of plasterboard, supported by metal studs. Such studs may be rolled to provide profiles suitable for supporting the desired number of panels in appropriate positions to meet the specified fire resistance or other characteristics. Such specialised studs can be expensive to produce, and a different profile is needed for each possible arrangement of panels.

In this specification the term "flange element" is used to denote the portions of a stud or support extending perpendicular to the web. Primarily these are the edge or side parts of an I or H stud but "flange element" is also used to denote medial shelving or secondary flange elements that may be provided along the length of the web. This shelving is not necessarily of one piece but may, for example, be effected by a number of aligned shelf portions.

SUMMARY OF THE INVENTION

According to the present invention there is provided a wall or lining structure comprising panel members supported by studs or supports having spaced parallel laterally extending flange elements, at least one panel member being held against the inner surface of at least one flange element of a stud or support by an independent angle channel or box spacer member inserted between an adjacent flange element and the panel, the cross-sectional dimensions of the spacer member being such that different numbers of thicknesses of the panel can be accommodated between the flange elements by varying the orientation of the spacer member relative to the stud.

The present invention thus provides a system by which wall structures with different arrangements of panel members can be erected from the same common supporting elements.

In accordance with this invention, supports or studs having spaced, parallel, laterally extending flanges are employed, for example I- or H-studs, together with separate or independent angle, channel or box members having cross-sectional dimensions that differ in different directions. The angle, channel or box members are employed as spacers between adjacent flanges of the studs and in different orientations can secure different numbers of panels against the inner face of one or both flanges.

The invention further provides for secondary flange elements to be formed along the length of the web of the stud or support. These flange elements may be utilised for the same purposes as the flange elements previously described. Secondary flange elements may be formed by various means, for example, longitudinally spaced tabs may be punched from the web and bent perpendicular to the web to form a flange element. Alternatively a flange element may be formed along the length of the web by roll forming during manufacture of the stud or support. These two methods may be used separately or combined. Secondary flange elements may be formed on each side of a stud or support.

It is convenient for the cross-sectional dimension of each separate spacer member in one direction to be less than the distance between adjacent flange elements on the stud by the thickness of one of the panel members employed, while the cross-sectional dimension of the spacer member in another direction is less than the distance between the flange elements by the extent of two thicknesses of the panel member. Other dimensional variations, however, can be employed.

Although an angle element of appropriate dimensions can be used as a spacer for the purposes of the invention, it is preferred to use channel or box members which offer much greater areas of contact to the items being spaced. A convenient cross-section for a channel or box member is one of four sides substantially defining an incomplete or unclosed rectangle. Although the length and width of the rectangle are best determined in relation to the studs and panels to be used, it is convenient for the length to be a whole multiple of the width. This enables the lesser dimension to be made substantially equal to the thickness of one panel member, which simplifies the design of alternative systems using the same studs and channel.

The spacers may be individual short lengths of the selected profile section, disposed at intervals along the stud. In many circumstances, and especially where fire resistance is a prime consideration, it is preferred to use continuous lengths of the selected section extending over all or most of the depth of the wall.

In order that panel members disposed against the inside face or faces of the stud flange elements should be firmly secured, it is preferable that such an open, substantially rectangular profile should have, in the free or unstressed condition, a right-angle between the two adjacent innermost sides and rather more than a right-angle between these sides and the free third and fourth sides. When the channel is fabricated from steel or other material commonly used for such purposes, the free or outer sides will have sufficient resilience to maintain a panel member or members securely against the inside face of flange elements when the channel is inserted as a spacing member. The angle between the inner and the outer sides is not critical but in most cases will conveniently be between 90° and 110°.

Although reference is frequently made herein to the use of I-or H-section studs in the practice of the invention, it will be apparent that other profiles can be used. For example, where the wall or lining abuts another wall or structure, the abutting stud will normally be of channel section. Furthermore, a pair of channel-section studs used back-to-back can be used instead of a single I- or H-section.

The simple I- or H-studs and the angle, channel or box members are easy and inexpensive to produce. If greater variation in panel numbers and situation is needed that can be accommodated by a single set of studs and spacer members, then it is equally easy and inexpensive to produce studs and/or spacer members of different dimensions to provide alternative sets covering a wide range of different cavity wall structures.

BRIEF DESCRIPTION OF DRAWINGS

The invention will be further described by way of example with reference to the accompanying drawings, in which.

Similar reference numerals are used in all the Figures to refer to similar items.

DETAILED DISCUSSION

Figure 1:
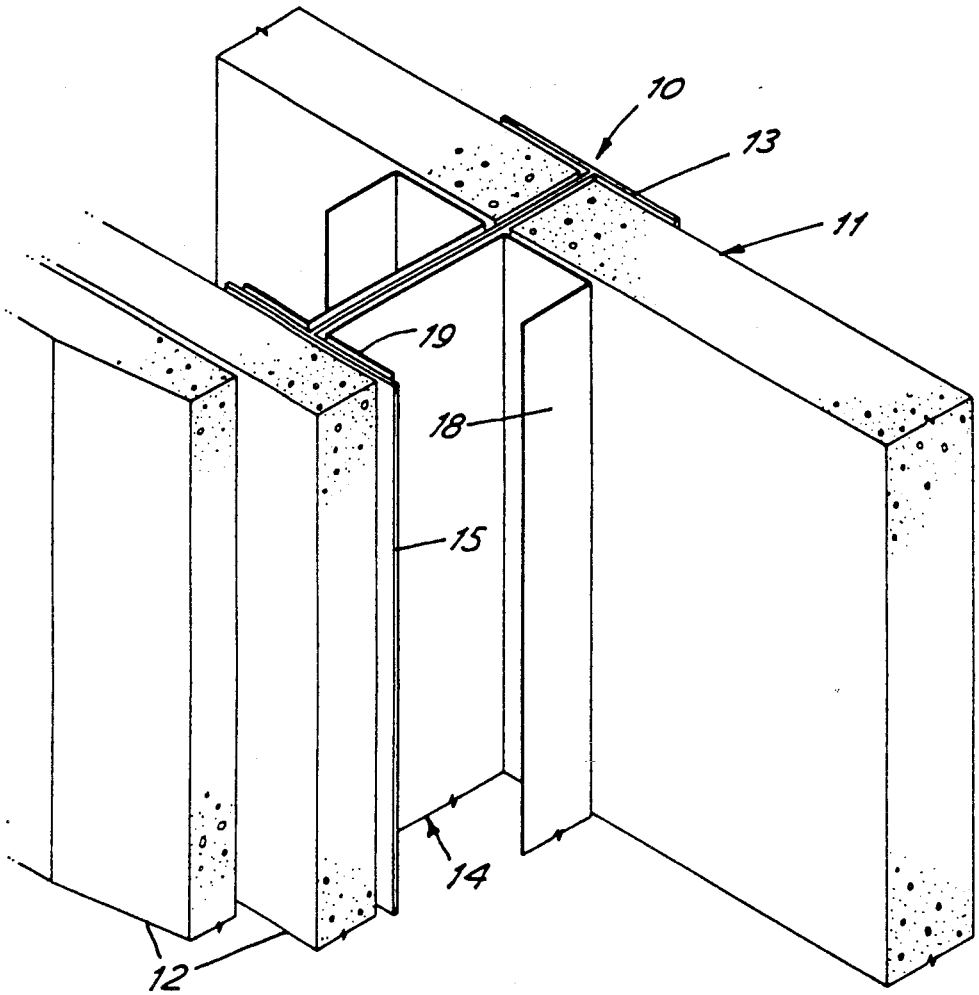
FIG. 1 is a cut-away perspective view of a cavity wall or lining structure according to the invention having one-hour fire resistance.

In the wall or lining shown in FIG. 1, a generally vertical I-section stud 10 supports three leaves or thicknesses, spaced by a cavity, for example one panel thickness of gypsum board 11 and two thicknesses of gypsum wallboard 12. The panels 11 are supported against the inner faces of the flange 13 of the stud 10 and are secured by the insertion of channel-section spacer members 14 between the panels 11 and the inner faces of the opposed flange 15 of the stud. The wallboards 12 are secured to the outer face of the flange 15 by screws or other conventional means.

Figure 5:
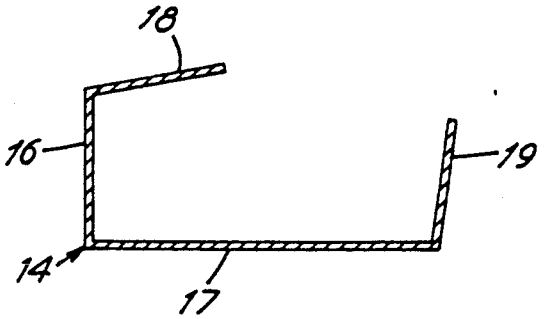
FIG. 5 is a cross-section of a preferred form of spacer member for use in the invention.

The spacer members 14 preferably have the profile shown in FIG. 5, which is that of an incomplete or open rectangle. In this example, the spacer has a sectional width approximately equal to the thickness of one panel 11 and a length of about twice this thickness.

The spacer section is preferably formed from a resilient material such as steel to have, in the free or unstressed condition, a right-angle between the inner pair of sides 16 and 17 and rather more than a right-angle, for example about 100°, between the respective inner sides and the outer or free sides 18 and 19. In the arrangement shown in FIG. 1, insertion of the spacers 14 leads to pressure on the end wall 19 of the channel, whereby the panels 11 are held firmly against the inner faces of the flange 13.

Figure 2:
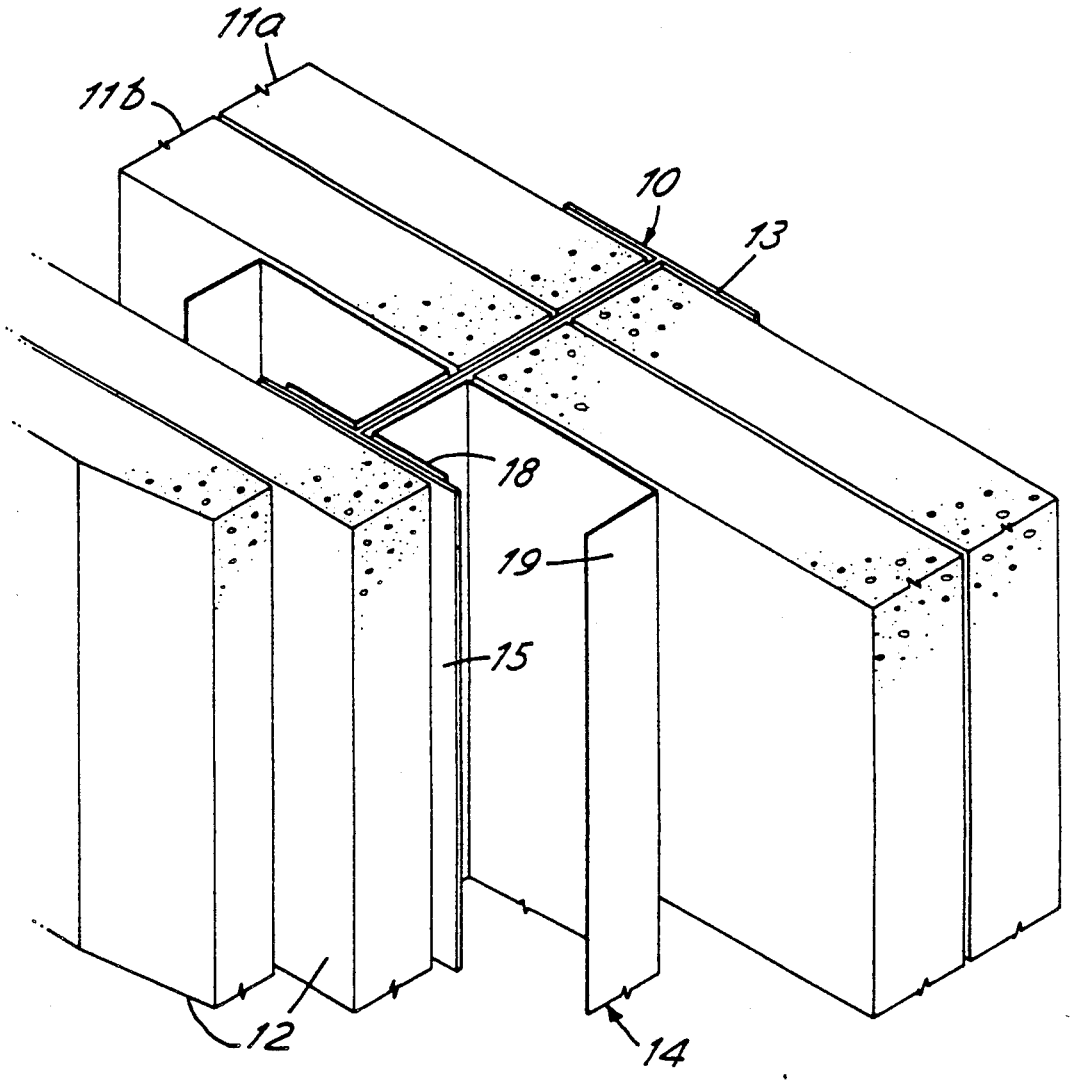
FIG. 2 is a similar view of a structure having two-hour fire resistance.

FIG. 2 shows a different wall structure having a greater fire resistance but formed from exactly the same materials as the structure of FIG. 1. In this structure, two thicknesses of gypsum board 11*a* and 11*b* are used, as well as two thicknesses of gypsum wallboard 12. The two thicknesses of board 11 are secured against the inner faces of the flange 13 by the insertion of respective spacers 14 in a different orientation from that used in FIG. 1. In this different orientation, it is the free or outer side 18 that bears against the inner faces of the flange 15 and, by its resilience, secures the two thicknesses of board firmly against the opposite flange.

In each case, the gypsum board secured to the outer face of the flange 15 may have a tapered edge to facilitate decoration and covering of the joint between adjacent boards in a conventional manner.

Wall structures according to the invention can have base and head structures adapted to the invention. Examples are shown in FIGS. 3 and 4, but either can be adapted to other applications of the invention, as will become apparent.

Figure 3:
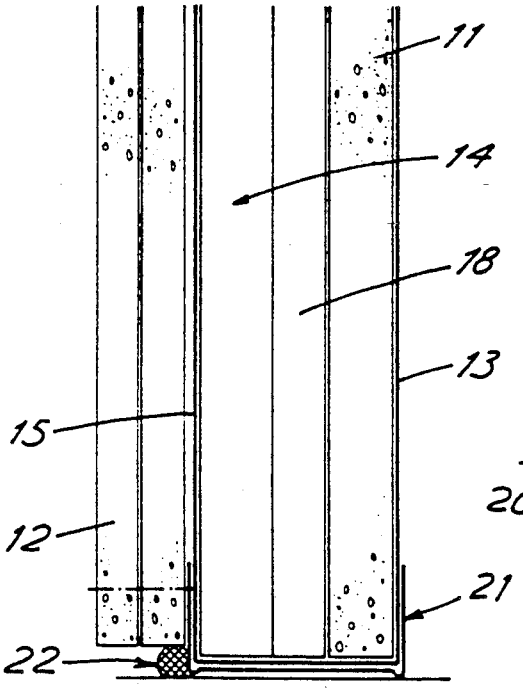
FIG. 3 is a cross-section of the base of the wall structure of FIG. 1.

The base structure shown in FIG. 3 corresponds to the wall structure of FIG. 1 and includes a floor channel 21 that accommodates the foot of the studs with their flanges 13 and 15, the planks 11 and the spacing channels 14. The wallboards 12 extend down the outside of the floor channel, and an acoustical sealant 22 is inserted between the bottom of the wallboards and the floor.

Figure 4:
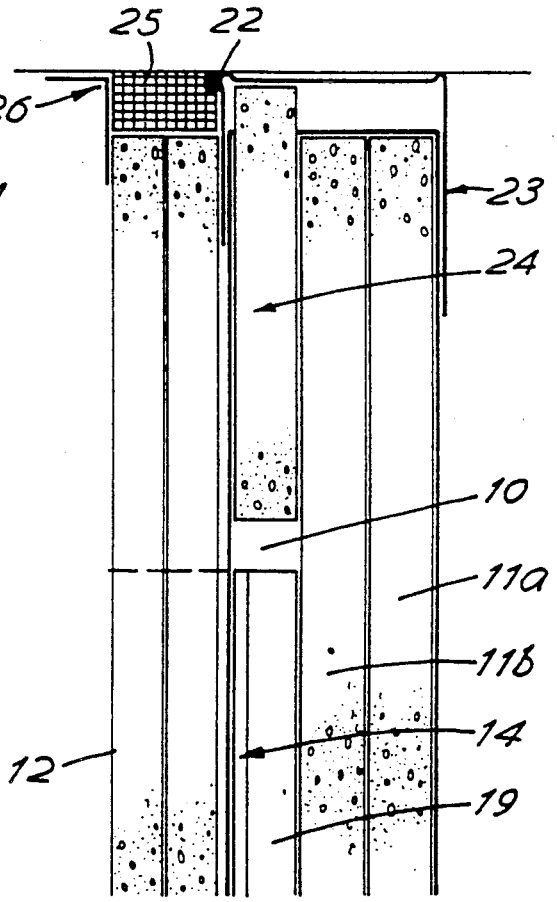
FIG. 4 is a cross-section of the head of the wall structure of FIG. 2.

In the head structure shown in FIG. 4, a J-section channel 23 is secured to the soffit and accommodates the tops of the studs 10 and two thicknesses of gypsum board 11*a* and 11*b*. The spacing channel 14 stops short of the top of the wall structure, and the corresponding space within the J-channel 23 is occupied by a further layer of gypsum board serving as a fire stop. Because the sectional width of the channel 14 is approximately equal to the thickness of the gypsum board employed, the space formed between the two boards and the flange 15 in FIG. 2 neatly accommodates the single thickness of the firestop board 24. Between the tops of the wallboard 12 and the soffit is inserted acoustical sealant 22 and a mat 25 of rock fibre. The latter is retained by an angle member 26 secured to the soffit.

Figure 6A:
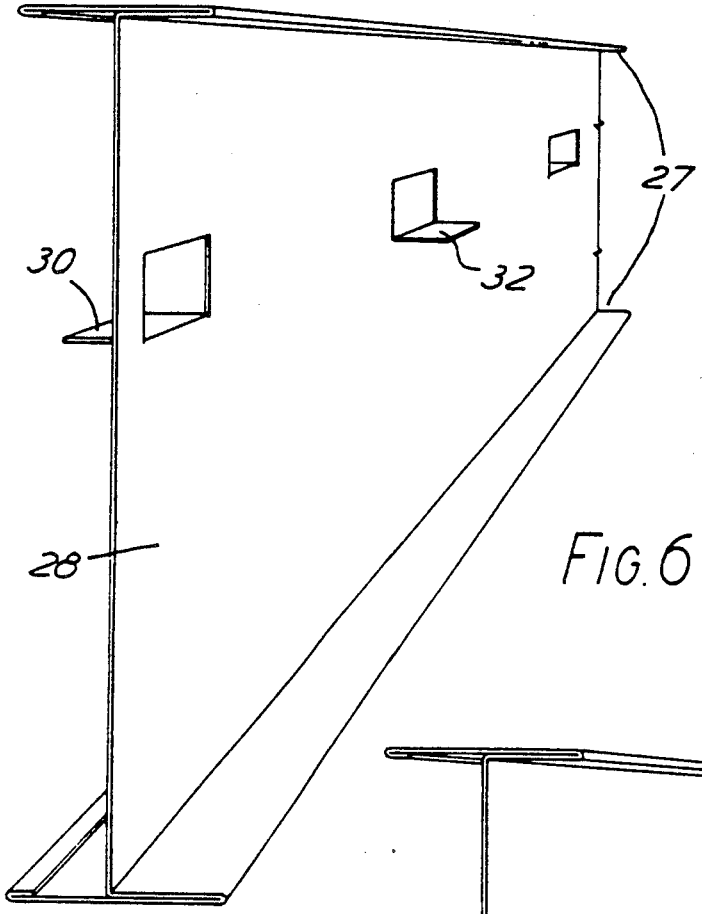
FIG. 6*a* is a perspective view of a stud for use in the present invention.
Figure 6B:
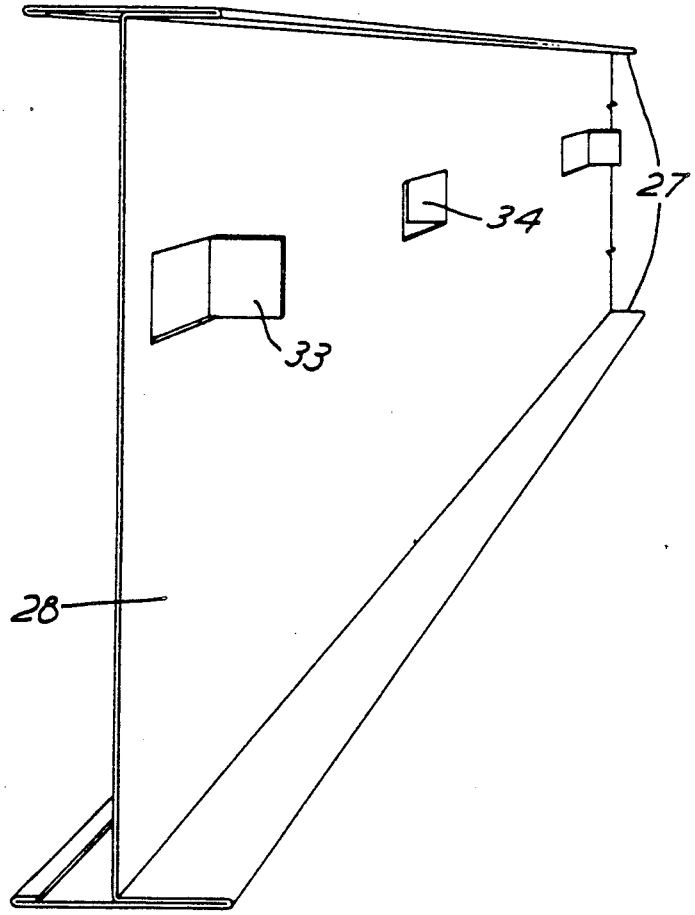
FIG. 6*b* is a perspective view of an alternative stud for use in the present invention.
Figure 7:
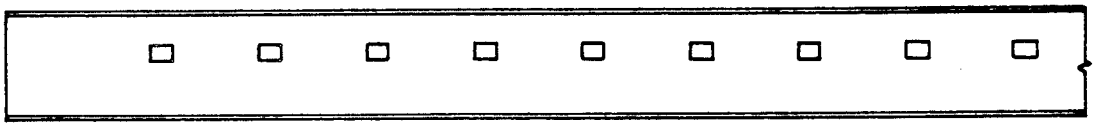
FIG. 7 is a side view of a section of the stud of FIG. 6*a*.

The studs shown in FIGS. 6*a* and 6*b* and 7 can accommodate a wider variety of panel assemblies.

The studs are of I type. Either or both of the flanges 27 at either side of the stud web 28 may be used as supports for wall panels. Unlike the studs previously shown however these studs have a pair of secondary flange elements constituted by two lines of tabs 30, 32 and 33, 34 perpendicular to and running along the length of the stud web, each tab being punched out of the material of the web. In the stud shown in FIGS. 6*a* and 7, the tabs (30, 32) are substantially parallel to the main flanges 27. In the case of the stud of FIG. 6*b* secondary flange elements constituted by two lines of tabs 33, 34 are perpendicular to the main flanges. In both cases, the tabs are formed alternately to one side and the other of the web so as to provide flange elements on each side. The tabs can act as supporting flange elements for retaining spacer members, or they can be used to support panels directly. The supporting surfaces of the flange elements in FIGS. 6*a* and 7 are the planar surfaces of the tabs, while the supporting surfaces of the flange elements in FIG. 6*b* are the tab edges facing the main flanges 27.

By providing secondary flange elements, a wider range of panel thicknesses and configurations can be achieved using basic stud and spacer members. Secondary flange elements may be formed in other ways for example by roll forming during initial manufacture of the stud. A combination of secondary flanging can also be used.

Figure 8:
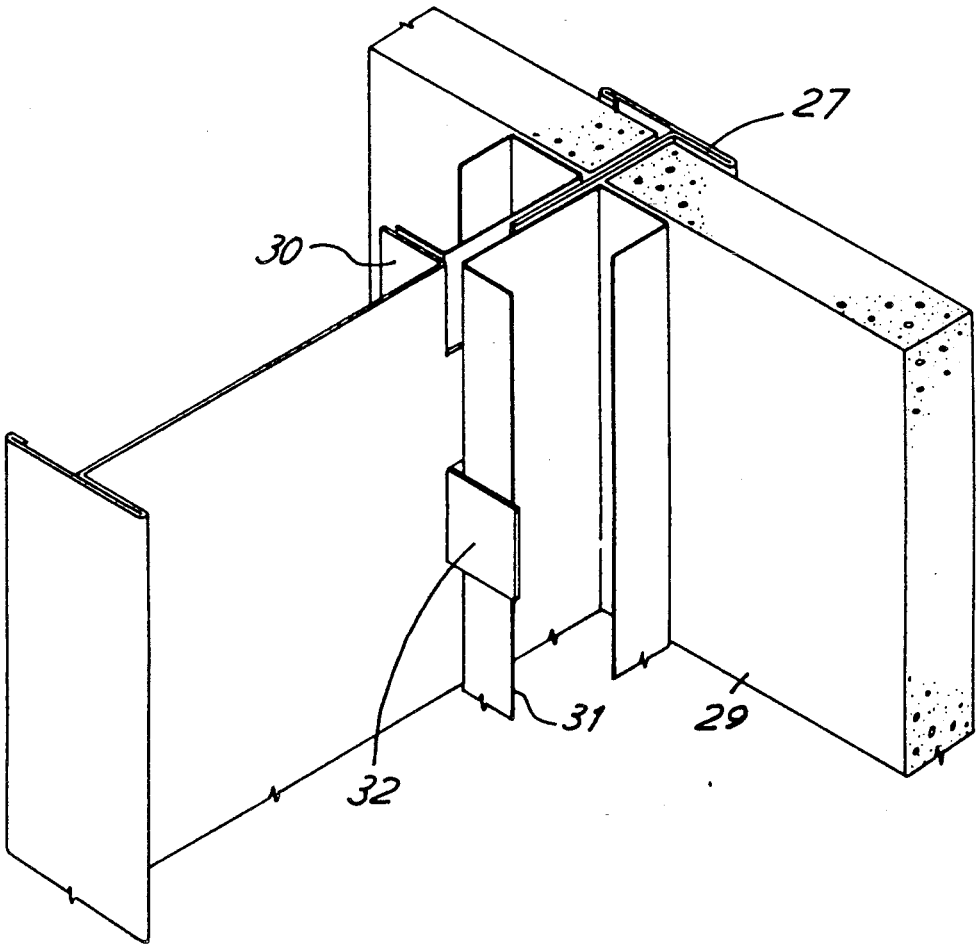
FIG. 8 is a cut away perspective view of a panel assembly according to the invention.

FIG. 8 shows a wall panel assembly using the stud of FIGS. 6*a* and 6*b* and 7. A wall panel 29 is supported against an inner face of a flange 27 by a retaining spacer member 31. The spacer member is supported by tabs 32 forming the flange element on one side of the web.

The walling system according to the invention has been found to afford very secure and continuous fixing of panel members in flanged supports, in a manner much superior to that provided by specially made stud sections, whether rolled to special profiles or having tabs punched out to hold boards in the desired positions. Moreover, the use of spacing channel or box members according to the invention provides a higher initial stability which is important for shaft linings, and a higher eventual stability where face boards have been applied, as with the panel members 12 in FIGS. 1 and 2. Furthermore, fire resistance is improved both in terms of stability and insulation, as compared with structures employing studs of special sections, while the system shows better mechanical restraint when subjected to fire and does not permit as much heat transfer as systems using integral, specially shaped studs.

What is claimed is:

1. A wall or lining structural unit comprising:

a support member having a web portion joining at least two parallel flange elements projecting laterally from and perpendicular to said web portion, so as to present at least a pair of opposing, mutually facing inner surfaces of said flange elements at a predetermined distance from one another;

at least one panel member of a predetermined thickness juxtapositioned to said support member; and at least one independent spacer member associated with said support member, inserted between said at least one panel member and at least one of said inner surfaces of said flange elements of said support member, said at least one independent spacer member having a cross-sectional profile with sides having first and second external dimensions of different magnitudes, said first dimension or length being equal to said predetermined distance between said at least two parallel flange elements of said support member minus said predetermined thickness of one of said panel members and said second dimension or width being equal to said predetermined distance between said at least two parallel flange elements of said support member minus at least two thicknesses of said predetermined thickness of one of said panel members such that different numbers of said panel members can be accommodated between said inner surfaces of said flanges of said support member by varying the orientation of said at least one spacer member relative to said web portion of said support member, said at least one panel member being positioned between at least one of said inner surfaces of said flange elements of said support member, said web portion of said support member and said at least one independent spacer member.

2. A wall structure according to claim 1, in which said web portion of said support member comprises two parallel longitudinal edges extending lengthwise thereto, each longitudinal edge having a primary flange element projecting therefrom perpendicular to said web portion and therefore inherently parallel to each other and at least one secondary flange element between said primary flange elements.

3. A structure according to claim 2, wherein said at least one secondary flange is formed from the material of said web portion of said support member.

4. A structure according to claim 3, wherein said at least one secondary flange element comprises a tab longitudinally spaced along said web portion of said support member.

5. A structure according to claim 1, wherein said at least one independent spacer member is comprised of four sides, two adjacent inner sides mutually contiguous, together defining substantially a right angle therebetween, and two outer sides, each outer side being coterminously contiguous with a respective one of said inner sides at respective internal angles greater than a right angle when said spacer member is in an unstressed condition, each of said outer sides extending from said respective corresponding inner sides in a manner in which said outer sides generally converge towards but do not contact each other.

6. A structure according to claim 2, wherein said support member comprises at least two primary flange elements one each extending from said respective longitudinal edges of said web portion and at least two secondary flange elements extending from said web portion between said at least two primary flange elements.

7. A structure according to claim 1, wherein said second of said external dimensions of said spacer member is equal to said predetermined distance between said at least two parallel flange elements minus two thicknesses of said panel member.

8. A structure according to claim 2, wherein said support member includes at least two secondary flange elements perpendicular to and running along a length of said web portion alternately to one side and the other of said web portion so as to provide secondary flange elements on each side of said support member.

9. A structure according to claim 8, wherein said secondary flange elements are provided so as to run spatially substantially parallel to said primary flange elements projecting from said longitudinal edges of said web portion of said support member.

10. A structure according to claim 8, wherein said secondary flange elements are provided so as to run spatially substantially perpendicular to said primary flange elements projecting from said longitudinal edges of said web portion of said support member.

11. A wall or lining structure comprising a plurality of structural units as described in claim 1.

* * * * *